US005421746A

United States Patent [19]

David

[11] Patent Number: 5,421,746

[45] Date of Patent: Jun. 6, 1995

[54] ORIENTATION AND POSITIONING DEVICE FOR ELECTRICAL CONNECTORS

[75] Inventor: James J. David, Mechanicsburg, Pa.

[73] Assignee: Berg Technology, Inc., Reno, Nev.

[21] Appl. No.: 121,024

[22] Filed: Sep. 13, 1993

[51] Int. Cl.[6] ..... H01R 13/502

[52] U.S. Cl. ..... 439/701; 439/76

[58] Field of Search ..... 439/686, 689, 695, 696, 439/701, 76, 77, 904, 906

[56] References Cited

U.S. PATENT DOCUMENTS

| | | | |
|---|---|---|---|
| 4,818,237 | 4/1989 | Weber | 439/677 X |
| 4,923,310 | 5/1990 | Sekiguchi et al. | 439/701 |
| 4,964,815 | 10/1990 | Kawai et al. | 439/906 X |
| 4,998,887 | 3/1991 | Kaufman et al. | 439/701 X |
| 5,108,313 | 4/1992 | Adams | 439/701 X |
| 5,125,846 | 6/1992 | Sampson et al. | 439/77 X |
| 5,149,274 | 9/1992 | Gallusser et al. | 439/76 |
| 5,299,940 | 4/1994 | Uenaka et al. | 439/76 |

*Primary Examiner*—Khiem Nguyen

*Attorney, Agent, or Firm*—Woodcock Washburn Kurtz Mackiewicz & Norris

[57] ABSTRACT

The current invention addresses a device to improve manufacturing of an outer shell modular connector which comprises overmold connectors. Each overmold connector comprises a circuit board to facilitate electrical connections. However, since each overmold connector provides multiple contact surfaces for specific electrical connections, the orientation of each circuit board with respect to the overmold connector is crucial for predetermined electrical connections. The outer shell modular connector in turn encases a number of the overmold connectors. The overmold connectors must be placed in a predetermined position and orientation within the outer shell modular connector so as to achieve desirable electrical connections. The predetermined orientation between the circuit board and the overmold connector is ascertained by a pair of polarization keys of the current invention. Similarly, another pair of the polarization keys ascertains the predetermined orientation between the overmold connector and the outer shell modular connector.

14 Claims, 4 Drawing Sheets

ORIENTATION AND POSITIONING DEVICE FOR ELECTRICAL CONNECTORS

BACKGROUND OF THE INVENTION

1. Field of the Invention

This invention relates to an electrical connector and in particular to a modular connector that ascertains the relative orientation of the electrical connectors therein.

2. Description of the Prior Art

In the past, a circuit board has been incorporated into an electrical connector for efficient organization of electrical connections. For example, a bus line connector can include an overmold which encases both electrical contact surfaces and a circuit board. The circuit board is connected to the individual bus wires on one end and the electrical contact surfaces on the other end. Multiple bus line connectors may be placed inside an outer shell so as to provide a more flexible organization for electrical connections. For example, a clamshell connector may encase multiple overmold connectors thereby providing a modular arrangement. In such a clam shell connector, the individual connectors may be stacked either side-to-side or end-to-end.

To assemble the above mentioned modular electrical connector, a manufacturing process requires a series of encasing components. A first step is to encase a circuit board in an overmold. Then, one or more of the overmolds are encased by an outer shell. During these processes, the orientation of each component is crucial in order to provide a correct electrical connection orientation. This orientation is sometimes also referred to as polarization. However, most components are symmetrical and do not provide a marker or other indicator for a correct assembly orientation with respect to other components. Even if such a marker is provided, it is possible to assemble the components with a wrong orientation. For example, a circuit board may be upside-down but may still fit in the overmold.

A mechanism to ascertain the correct orientation of the connector components is not only necessary for manufacturing but also for maintenance and later modifications. For example, when certain wires in a modular connector are determined to be severed, only the overmold containing the severed wires is replaced while other overmolds remain intact. However, during this repair it is crucial to maintain the original and correct orientation of these severed wires and repairs the overmold with respect to other overmolds in the outer shell.

U.S. Pat. No. 5,108,313 issued to Adams discloses a modular connector which contains multiple unit casings. Each unit casing provides terminals for multiple wires. Although this patent discloses a groove on the overmold casing and a matching ledge on the outer shell of the modular connector, there is no mechanism to ensure the correct polarity of the wiring of each overmold with respect to the casing. In other words, this patent does not disclose a mechanism to ascertain a relative position of each casing within the modular connector.

The patent to Adams also does not address polarization of each overmold connector within the modular casing. An overmold may be placed in a correct relative position, but may not be correctly polarized. That is, the orientation of the mold with respect to the outer shell is not ascertained by the prior art disclosure.

It is clear that there has existed a long and unfilled need in the art for an improved device for ascertaining a predetermined position and orientation of electrical connections in a connector which overcomes the disadvantages discussed above.

SUMMARY OF THE INVENTION

Accordingly, it is an object of the current invention to provide a mechanism to provide an apparatus for ascertaining the orientation of the electrical connections of a connector with respect to its corresponding receptacle.

It is an object of one aspect of the current invention to ascertain the predetermined orientation of electrical connections of a circuit board with respect to an overmold connector so as to provide predetermined electrical connections.

Another object of the current invention is to provide a mechanism to ascertain the predetermined orientation of an overmold connector with respect to an outer shell modular connector so as to provide predetermined electrical connections.

Yet another object of the current invention is to provide a mechanism to ascertain a predetermined position of an overmold connector within an outer shell modular connector when more than one overmold connector is encased by the outer shell connector so as to provide predetermined electrical connections.

A further object of the current invention is to provide a direct access area on the circuit board when the circuit board is encased in the overmold connector.

To achieve the above and other objects of the invention, according to the current invention, one embodiment of an apparatus for ascertaining predetermined electrical connections includes a circuit board which is connected to at least one electrical wire for providing terminals for predetermined electrical connections; a first polarization key which is disposed on the circuit board for uniquely specifying a predetermined orientation of the circuit board; a first casing which is disposed on outside surfaces of the circuit board for encasing the circuit board so as to electrically shield the circuit board; a second polarization key which is disposed on the first casing for engaging the first polarization key so as to ascertain the predetermined orientation of the circuit board with respect to the first casing; a third polarization key disposed on the first casing for uniquely specifying the predetermined orientation of the first casing; a second casing disposed on outside surfaces of the first casing for further encasing at least one of the first casings; and a fourth polarization key disposed on the second casing for engaging the third polarization key so as to ascertain the predetermined orientation of the first casing with respect to the second casing.

According to one aspect of the current invention, the second polarization key exposes a part of the circuit board so as to allow access to the circuit board when the circuit board is encased in the first casing.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
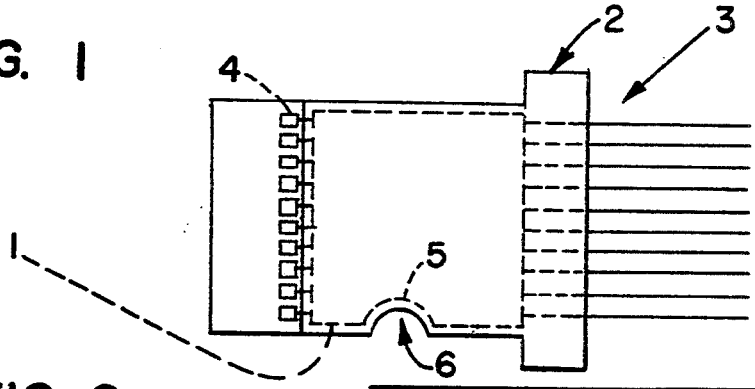
FIG. 1 diagrammatically illustrates one embodiment of a polarization mechanism as applied to a circuit board and an overmold casing.

Referring now to the drawings, wherein like reference numerals designate corresponding structure throughout the views, and referring in particular to FIG. 1, a circuit board 1 is shown to be encased in an overmold casing 2. The circuit board 1 provides an interface between electrical wires 3 on one end and contact surfaces 4 on the other end. The use of the circuit board 1 facilitates a manufacturing process for complex connections between the wires 3 and the contact surfaces 4. However, during the manufacturing process, the circuit board 1 must be correctly oriented with respect to the overmold casing 2 so as to maintain a predetermined orientation or contact surfaces 4.

Still referring to FIG. 1, one embodiment of a polarization key 5 is placed on one edge of a circuit board 1. Although a location and shape of the polarization key 5 does not have any particular requirement, the polarization key 5 of the circuit board 1 must be unique and must be complementary to a polarization key 6 of the overmold casing 2. According to one embodiment of the current invention, the polarization key 5 is a semicircular indentation while overmold casing 2 defines polarization key 6 as a complementary fitting semicircular protrusion. Such an arrangement of circuit board and overmold provides a readily ascertainable orientation of the circuit board with respect to overmold casing 2.

Figure 2:
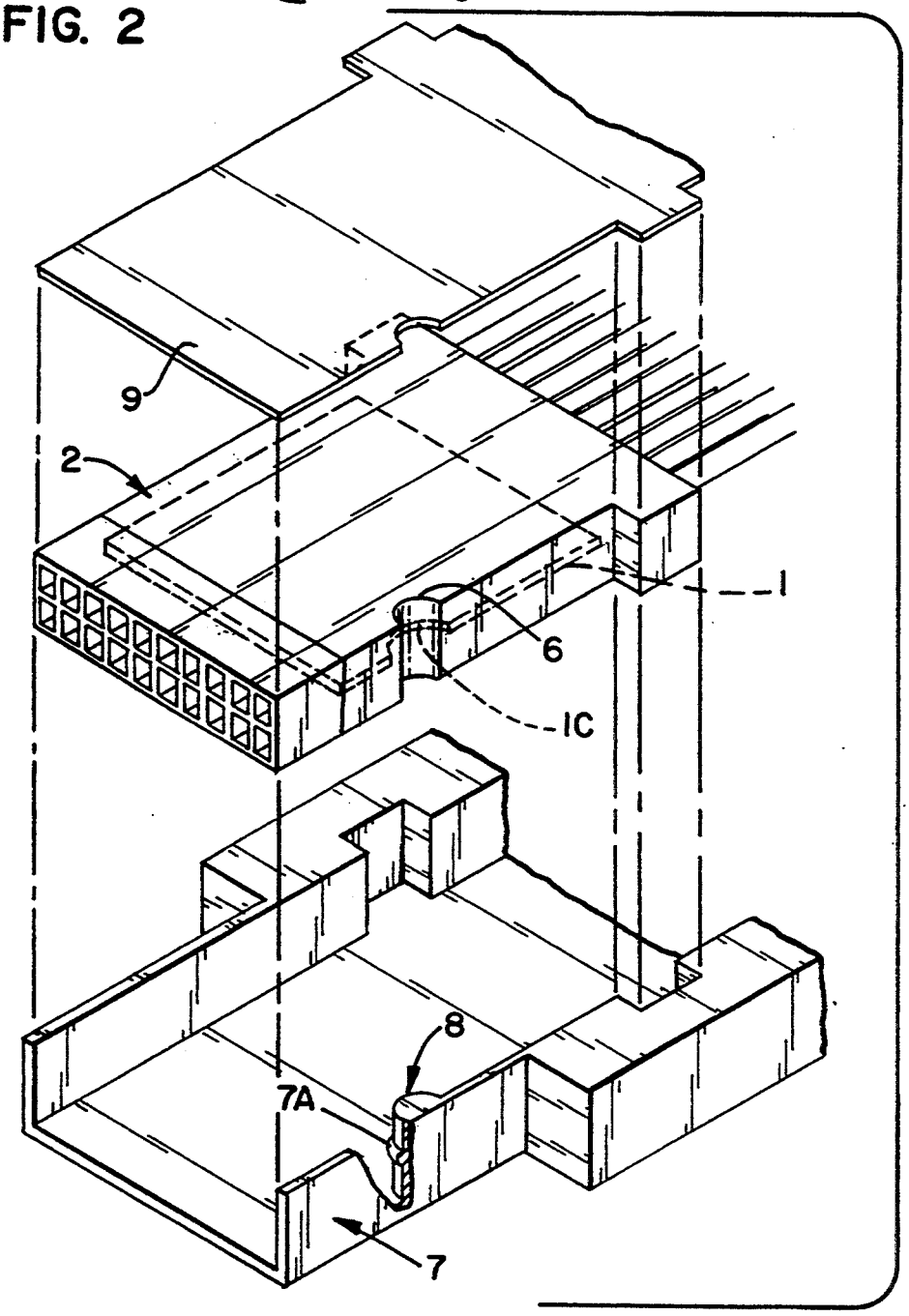
FIG. 2 diagrammatically illustrates another embodiment of the polarization mechanism as applied to an outer shell modular casing and the overmold casing as shown in FIG. 1.

Now referring to FIG. 2, an overmold casing 2 which houses a correctly-orientated circuit board 1 is placed in an outer shell modular casing 7. This manufacturing process also requires a predetermined placement of the overmold casing 2 with respect to the outer shell modular casing 7 so as to maintain the predetermined electrical contact orientation. According to one embodiment of the current invention, another polarization key 8 prevents the overmold casing 2 from wrongly being placed in the outer shell modular casing 7 as shown in FIG. 2 during assembly. The polarization key 8 of the outer shell modular casing 7 uniquely fits the polarization key 6 of the overmold casing 2. If the overmold casing 2 is not correctly oriented with respect to the outer shell modular casing 7, the overmold casing 2 will not fit in outer shell modular casing 7. In such a situation, the outer shell modular casing cannot be finally assembled with top cover 9.

The polarization key 6 in this embodiment as shown in FIG. 2 has a dual function: While a protrusion surface of the polarization key 6 provides a matching key to the polarization key 5 on the circuit board 1, an indentation surface of the polarization key 6 provides a matching key to the polarization key 8. It is within the scope of the invention for polarization key 6 to include two independent parts to respectively match the polarization keys 5 and 8.

FIG. 2 also illustrates another feature of the overmold casing 2. Polarization key 6 may be designed to expose one edge of circuit board 1 for direct electrical access after the circuit board is encased in the overmold casing 2. To this end direct access area 1C may be used for grounding circuit board 1 so as to eliminate a ground wire from wires 3. The direct access area 1C in turn is connected to an outer shell modular casing access area 7A. It is preferred for access area 7A to be biased outwardly. In such an arrangement, electrical contact between access area 7A and circuit board 1 is assured.

Figure 3A:
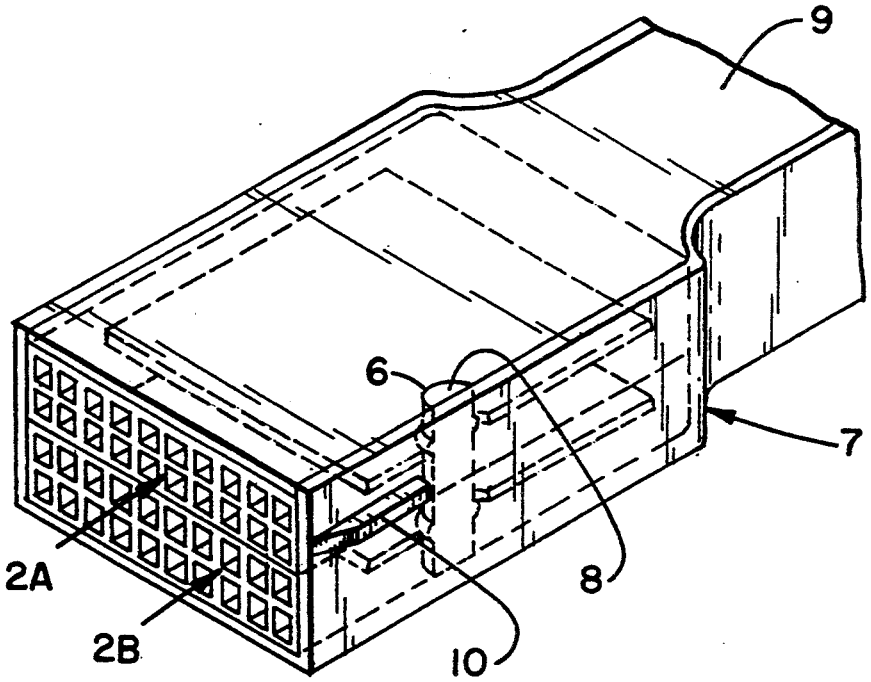
FIG. 3A illustrates a prospective view of a modular outer shell encasing two vertically stacked overmolds each of which contains a circuit board as shown in FIG. 1.
Figure 3B:
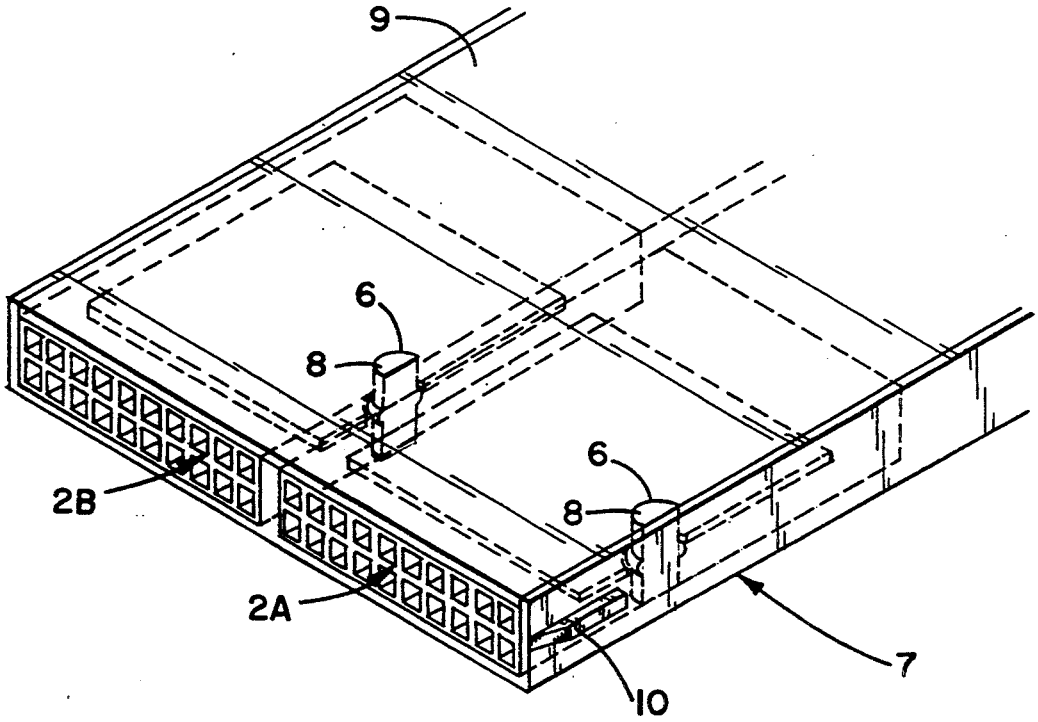
FIG. 3B shows a prospective view of another embodiment of an outer shell modular casing which houses two over mold casings placed side-by-side.

Referring now to FIG. 3A, multiple overmold casings 2A and 2B are placed in a outer shell modular casing 7. In this embodiment, the two overmold casings 2A, 2B are stacked on top of each other thereby providing a larger number of contact surfaces. In another embodiment as shown in FIG. 3B, two overmold casings 2A, 2B are placed side-by-side. As shown in FIGS. 3A and 3B, a polarization key 6 of each overmold casing 2A, 2B fits a corresponding polarization key 8 of an outer shell modular casing 7. The outer shell modular casing 7 also has a polarization key 10 on an outer surface so that it may be correctly inserted into a receptacle at the predetermined orientation.

Figure 4:
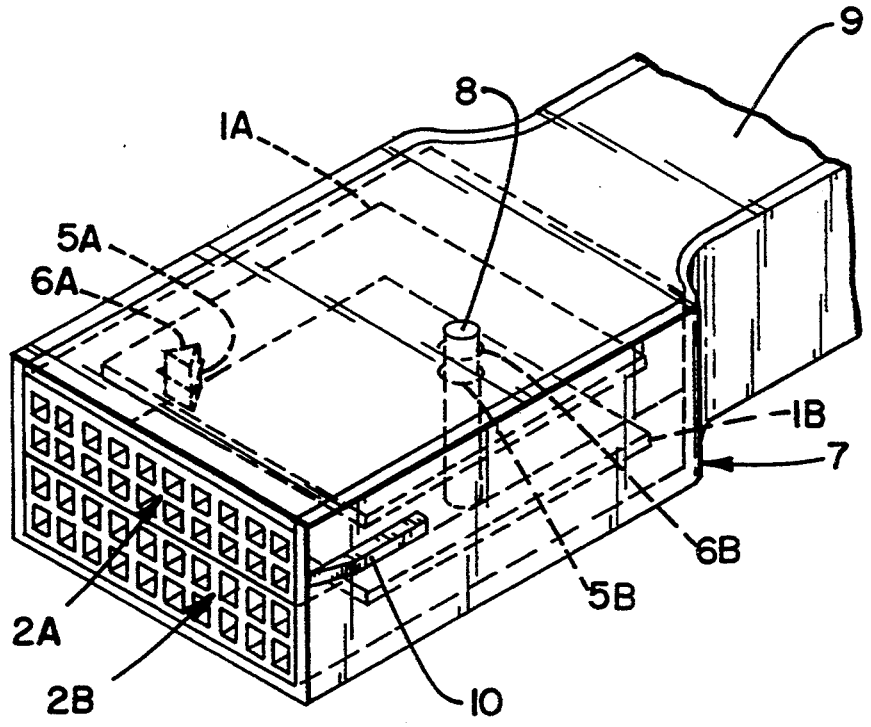
FIG. 4 illustrates yet another embodiment of the polarization mechanism as applied to the two vertically stacked overmold casings as shown in FIG. 3A.

Referring to FIG. 4, another embodiment of the polarization keys 5A, 5B, 6A, 6B and 8 are shown. In FIGS. 1-3, the polarization keys are disposed either on an edge of the circuit board 1 or the casings 2 or 7. As shown in FIG. 4, the polarization keys may be disposed on a non-edge surface. A triangular columnar structure 6A vertically extends from an inner surface of the overmold casing 2A to serve as a polarization key. The circuit board 2 provides a fitting triangular bore 5A to correctly polarize the circuit board 1A with respect to the overmold size 2A. Similarly, in order to orient the overmold casing 2A with respect to the outer shell casing 7 with a predetermined polarization, a circular column structure 8 vertically extends from an inner surface of the top cover 9. A complementary circular bore 6B on the overmold casing 2A and another complementary circular bore 5B on the circuit board 1A uniquely accept the columnar structure 8 as a polarization key to ascertain that all the components are orientated in a predetermined manner. By the same token, the overmold 2B and the circuit board 1B have corresponding bores to uniquely accept the column 8.

It is also crucial that multiple overmold casings 2 are correctly placed with respect to each other in the outer shell modular casing 7. In other words, even though the overmold casings 2 are placed at the predetermined orientation within the outer shell modular casing, if each overmold casing 2 is not placed at a predetermined position within the outer shell modular casing 7, desirable connections are not ensured.

Figure 5:
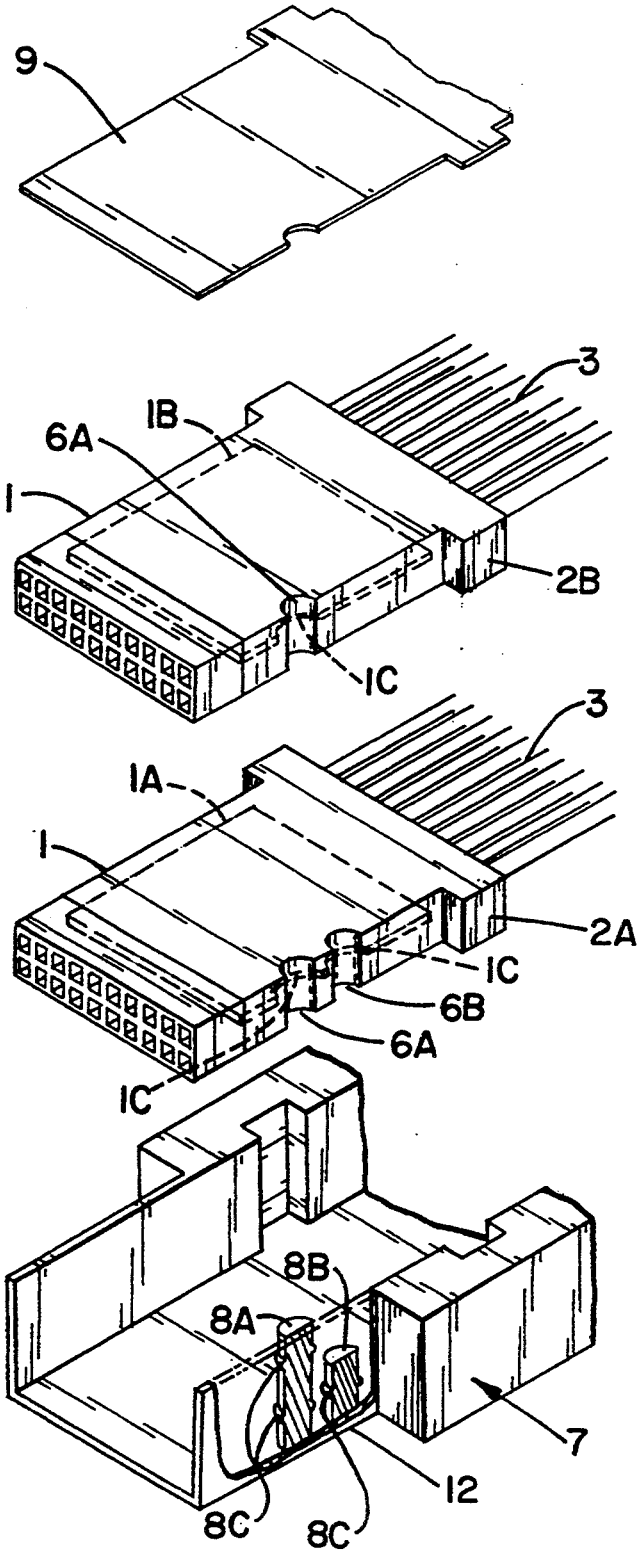
FIG. 5 diagrammatically illustrates one-to-one exclusive fitting between a particular overmold casing and its predetermined position within a outer shell modular casing.

Now referring to FIG. 5, multiple overmold casings 2 are orientated and positioned within the outer shell modular casing 7. According to one embodiment of the current invention as shown in FIG. 5, a unique position and orientation of a particular overmold casing with respect to the outer shell modular casing 7 is ascertained by a one-to-one exclusive fit between polarization keys 6A, 6B of the particular overmold casing and corresponding polarization keys 8A, 8B of the outer shell modular casing 7. The overmold casing 2A is placed at the bottom of the outer shell modular casing 7, and then the overmold casing 2B is placed above the overmold casing 2A in the outer shell modular casing 7. Otherwise, the top cover 9 cannot be placed on the top of the outer shell modular casing 7. In this embodiment, the overmold casing 2B is prevented from being placed at the bottom of the outer shell modular casing 7 due to the lack of a corresponding polarization key on the overmold casing 2B to the polarization key 8B of the outer shell modular casing 7. In fact, the overmold casing 2B cannot physically be placed at the bottom of the outer shell modular casing 7. Thus, according to the current invention, the predetermined orientation and position of overmold casings 2A and 2B are ascertained with respect to the outer shell modular casing 7.

Still referring to FIG. 5, as described with reference to FIG. 2, the overmold casings 2A and 2B may expose an edge of encased circuit boards 1A, 1B for providing direct access to the circuit boards 1A, 1B via direct access areas 1C. Such direct access may be used for grounding the circuit boards 1A, 1B through corresponding contact areas 8C of the polarization keys 8A and 8B where the outer shell modular casing provides access to ground upon insertion in a predetermined receptacle (not shown). One advantage of grounding by the direct access eliminates a grounding wire from the electrical wires 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts such as polarization keys within the principles of the invention to the full extent indicated by the broad general meaning of the terms in which the appended claims are expressed.

What is claimed is:

1. Apparatus for ensuring the polarity of predetermined electrical connections, comprising:

a circuit board to which at least one electrical wire for providing terminals for said predetermined electrical connections;

a first polarization key disposed on said circuit board for uniquely specifying a predetermined orientation of said circuit board so as to achieve said predetermined electrical connections;

a first casing disposed on outside surfaces of said circuit board for encasing said circuit board so as to electrically shield said circuit board;

a second polarization key disposed on said first casing for uniquely engaging said first polarization key so as to ascertain said predetermined orientation of said circuit board with respect to said first casing;

a third polarization key disposed on said first casing for uniquely specifying said predetermined orientation of said first casing;

a second casing disposed on outside surfaces of said first casing for further encasing at least one of said first casing; and a fourth polarization key disposed on said second casing for uniquely engaging said third polarization key so as to ascertain said predetermined orientation of said first casing with respect to said second casing for said predetermined electrical connections.

2. Apparatus according to claim 1 wherein said first polarization key is a first uniquely identifiable indentation on one edge of said circuit board.

3. Apparatus according to claim 2 wherein said second polarization key is a complementary protrusion to said first uniquely identifiable indentation so as to interlock said first uniquely identifiable indentation for ascertaining said predetermined orientation of said circuit board with respect to said first casing.

4. Apparatus according to claim 3 wherein said third polarization key is a second uniquely identifiable indentation.

5. Apparatus according to claim 4 wherein said fourth polarization key is a complementary protrusion to said second uniquely identifiable indentation so as to interlock said second uniquely identifiable indentation for ascertaining said predetermined orientation of said first casing with respect to said second casing.

6. Apparatus according to claim 1 wherein said second polarization key exposes a part of said circuit board so as to allow access to said circuit board when encased in said first casing.

7. Apparatus according to claim 1 further comprises:

a plurality of said circuit boards;

a plurality of said first keys;

a plurality of said first casings;

a plurality of said second keys;

a plurality of said third keys;

a plurality of said second casings; and a plurality of said fourth keys.

8. Apparatus according to claim 7 wherein each of said first polarization keys uniquely engages with one of corresponding said second polarization keys so as to ascertain a predetermined position and orientation of each of said circuit boards within corresponding said first casings.

9. Apparatus according to claim 7 wherein each of said third polarization keys uniquely engages with one of corresponding said fourth polarization keys so as ascertain a predetermined position and orientation of each of corresponding said first casings within each of corresponding said second casings.

10. Apparatus for ascertaining a plurality of predetermined electrical connections, comprising:

a plurality of connectors for providing independent contact surfaces, each of said connectors having a polarized circuit board inside and outside walls;

a first polarization means disposed on one of said outside walls of said connectors;

an outer shell encasing said plurality of connectors, said outer shell having inside walls; and a second polarization means disposed on said inside walls for uniquely engaging each of said first polarization means when said outer shell encases said connectors, thereby said second polarization means ascertaining a predetermined orientation and position of each of said connectors with respect to said outer shell, wherein said outer shell further comprises outside walls, a corresponding receptacle and a third polarization means disposed on one of said outside walls for ascertaining said predetermined orientation of said connector with respect to said corresponding receptacle when said outer shell is connected to said receptacle.

11. Apparatus according to claim 10 wherein said first polarization means comprises a geometrically unique configuration.

12. Apparatus according to claim 11 wherein said second polarization means comprises a complementary configuration to said geometrically unique configuration for an exclusive one-to-one fit.

13. Apparatus according to claim 12 wherein said geometrically unique configuration is a semi-cylindrical protrusion while: said complementary configuration is a semi-cylindrical indentation.

14. A clam shell connector for ascertaining a plurality of predetermined electrical connections, comprising:

a circuit board providing a terminal for said predetermined electrical connections, a part of said circuit board having a unique geometrical configuration for specifying a predetermined orientation;

an overmold connector for encasing said circuit board, a part of said overmold having a first complementary geometrical configuration to said unique geometrical configuration of said circuit board for uniquely engaging said unique geometrical configuration so as to ascertain said predetermined orientation; and a clamshell connector for encasing at least one of said overmold connector, said clamshell connector also having a second complementary geometrical configuration to said first complementary geometrical configuration for uniquely engaging said overmold connector so as to ascertain said predetermined orientation of said circuit board with respect to said clamshell connector.

* * * * *